US008430588B2

(12) United States Patent
Haack

(10) Patent No.: US 8,430,588 B2
(45) Date of Patent: Apr. 30, 2013

(54) APPLICATION NOZZLE FOR VISCOUS ADHESIVES

(75) Inventor: Thomas Haack, Weitzschen (DE)

(73) Assignee: Bona GmbH Deutschland, Limburg a. d. Lahn (DE)

( * ) Notice: Subject to any disclaimer, the term of this patent is extended or adjusted under 35 U.S.C. 154(b) by 0 days.

(21) Appl. No.: 13/386,442

(22) PCT Filed: Jul. 13, 2010

(86) PCT No.: PCT/EP2010/004253

§ 371 (c)(1),
(2), (4) Date: Jan. 23, 2012

(87) PCT Pub. No.: WO2011/012221

PCT Pub. Date: Feb. 3, 2011

(65) Prior Publication Data

US 2012/0121315 A1 May 17, 2012

(30) Foreign Application Priority Data

Jul. 25, 2009 (DE) ..... 10 2009 034 774

(51) Int. Cl.
*B43M 11/06* (2006.01)

(52) U.S. Cl.
USPC ..... 401/139; 401/5; 401/263; 401/266

(58) Field of Classification Search ..... 401/5, 139, 401/200, 205, 263, 266; 222/566; 425/87, 425/458; 239/553.5, 590.5
See application file for complete search history.

(56) References Cited

U.S. PATENT DOCUMENTS

| | | | | | |
|---|---|---|---|---|---|
| 1,141,103 | A | * | 6/1915 | Casler | 401/263 |
| 1,982,833 | A | * | 12/1934 | Schmerler | 401/278 |
| 2,008,636 | A | * | 7/1935 | Brynan | 401/262 |
| 2,559,553 | A | * | 7/1951 | Wolff | 401/172 |
| 2,609,240 | A | * | 9/1952 | Faulkner et al. | 239/553.5 |
| 2,636,214 | A | * | 4/1953 | Slusher | 401/176 |
| 2,804,767 | A | * | 9/1957 | Schoen | 401/9 |
| 3,365,746 | A | * | 1/1968 | Gott | 401/139 |

(Continued)

FOREIGN PATENT DOCUMENTS

| | | | |
|---|---|---|---|
| BE | 1016978 | A3 | 7/2006 |
| DE | 19928030 | A1 | 12/2000 |

(Continued)

*Primary Examiner* — Huyen Le
*Assistant Examiner* — Bradley Oliver
(74) *Attorney, Agent, or Firm* — Novak Druce Connolly Bove + Quigg LLP

(57) ABSTRACT

An application nozzle for viscous adhesives has a nozzle housing (1) encompassing an interior (4) that has an application edge (6) along which a plurality of nozzle openings (8, 33) are arranged, and has at least one feed opening (5) located opposite from the application edge (6). The interior (4) of the nozzle housing (1) widens from the feed opening (5) towards the nozzle openings (8, 33), as seen in the direction of the application edge (6). Flow elements (9, 10, 11) to convey the adhesive from the feed opening (5) to the nozzle openings (8, 33) are provided in the interior (4) of the nozzle housing (1) and at least one flow element (9, 10, 11) that has an inflow edge (12) and an outflow edge (13) and that is oriented in such a way that the flow element, while being completely surrounded by the volume flow of adhesive, uniformly distributes the volume flow of adhesive, taking into consideration the different flow paths leading from the feed opening (5) to the individual nozzle openings (8, 33).

21 Claims, 4 Drawing Sheets

U.S. PATENT DOCUMENTS

| | | | | |
|---|---|---|---|---|
| 5,387,044 | A * | 2/1995 | Accardo | 401/5 |
| 5,695,788 | A * | 12/1997 | Woods | 425/87 |
| 5,873,666 | A * | 2/1999 | Bourke et al. | 401/1 |
| 5,882,133 | A | 3/1999 | Chao et al. | |
| 7,325,995 | B2 * | 2/2008 | Keller | 401/266 |
| 7,999,752 | B2 | 8/2011 | Riedel | |
| 2008/0283537 | A1 * | 11/2008 | Smith et al. | 222/566 |

FOREIGN PATENT DOCUMENTS

| | | | |
|---|---|---|---|
| EP | 1447142 | A1 | 8/2004 |
| EP | 2054969 | A1 | 5/2009 |
| JP | 11-290746 | A | 10/1999 |
| WO | WO-0069571 | A1 | 11/2000 |
| WO | WO-2004/065023 | A1 | 8/2004 |

* cited by examiner

APPLICATION NOZZLE FOR VISCOUS ADHESIVES

CROSS-REFERENCE TO RELATED APPLICATIONS

This application is a national stage application (under 35 U.S.C. §371) of PCT/EP2010/004253, filed Jul. 13, 2010, which claims benefit of German application 10 2009 034 774.7, filed Jul. 25, 2009.

TECHNICAL FIELD AND STATE OF THE ART

The present invention relates to an application nozzle for viscous adhesives, having a nozzle housing encompassing an interior, having an application edge along which a plurality of nozzle openings are arranged, and having at least one feed opening located opposite from the application edge, whereby the interior of the nozzle housing widens from the feed opening towards the nozzle openings, as seen in the direction of the application edge, and whereby means to convey the adhesive from the feed opening to the nozzle openings are provided in the interior of the nozzle housing.

To put it more precisely, the invention relates to special nozzles with which high-viscosity adhesives can be applied as a multiple bead in rib form or as a film with embossed ribs onto a flat substrate. The appertaining application nozzle is used in conjunction with commercially available or tailor-made application devices. The adhesive can be fed from cartridges or pouches containing adhesive. It is likewise conceivable for the adhesive to be fed from a separate reservoir via suitable pipelines or tubes or a combination thereof.

Floor coverings and hardwood are often glued onto a floor over the entire surface. For this purpose, the adhesives for the floor covering or hardwood floors are applied in pasty form onto the subflooring and then spread over the entire surface of the subflooring by means of a so-called serrated spatula.

Such a wood floor is described, for example, in German patent application DE 199 28 030 A1.

The notches on the serrated spatula and the hand position of the installer give rise to a given specific application amount and creates a rib-like pattern on the subflooring which is compressed at various places after the floor covering or hardwood floors have been installed, but which often forms webs between the subflooring and the floor covering or hardwood floors, due to uneven places in the subflooring or in the floor covering.

In order to make it possible to work with the above-mentioned adhesives having high viscosities or flow points, dispensing guns for cartridges or pouches often are used. Such dispensers are familiar and widely available for applying sealing compounds. Nozzles having an opening are normally used for this purpose, and the sealing compound is thus applied as a virtually one-dimensional bead, as is shown in European patent specification 0254969 B1, which describes a device for dispensing pasty compounds in the form of a bead.

Adhesives for floor coverings and hardwood floors, however, are applied "over the entire surface" and consequently, a nozzle having several openings is needed so as to create an adhesive pattern on the substrate that is identical or similar to what is created using a regular serrated spatula.

Nozzles for applying an adhesive in several beads are described, for example, in U.S. Pat. No. 5,882,133 and international patent application WO 2004/065023 A1.

In U.S. Pat. No. 5,882,133, a nozzle is employed to apply parallel beads of adhesive onto the back of laminated panels in order to glue them onto the subflooring. As a special feature, the application nozzle according to U.S. Pat. No. 5,882,133 has three nozzle openings, of which the one in the middle has a circular cross section, while the two outer nozzles have an oval cross section, apparently so that the flow paths, which are of different lengths, can be at least partially compensated for.

WO 2004/0650231 A1 describes a device for applying glue, comprising two or three glue cylinders to whose outlets a glue scraper having several dispensing openings is attached. The individual channels in the glue scraper fan out from the outlet of the glue cylinder all the way to the dispensing openings, as a result of which they have different lengths.

Japanese patent application JP 11-290 746 A discloses a device with several outlet openings. In order to dispense a uniform amount from all of the outlet openings, the device has several feed arms that lead to the individual outlet openings and that are all of the same length. This is achieved by a special cascade arrangement in which twice the number of identical additional cascade arms are coupled to the feed arms that belong to the preceding cascade and that are of the same length.

All of the devices have in common the fact that a nozzle having several dispensing openings is installed on the reservoir for the adhesive. The reservoir can be, for example, a cartridge or a cylinder that holds pouches. The nozzle dispenses the adhesive mechanically or electrically by means of compressed air. As a result, the application is neater and easier on the joints, especially on the hands and knees, particularly in the case of high-viscosity adhesives.

For many adhesives, there is a desire for a high initial adhesion after the substrates have been joined. In many cases, the initial adhesion can also be achieved by modifying the rheological properties, especially in that the product is formulated so as to have a higher viscosity or a higher flow point. Such modifications of the rheological properties, however, cause the "spreading" procedure, which is normally done with a conventional serrated spatula, to be considered by the user as being "hard", causing considerable strain of the hand or arm used for the application. Such high viscosities or flow points are consequently often rejected by users and are thus not commercially available.

In this context, the equipment of the current state of the art has nozzles in which several channels radiate from the reservoir and open up into the outlet openings. The geometry of the channels used for the distribution over the individual outlet openings gives rise to different flow paths for the adhesive. This causes an irregular application of the adhesive, which can then be manipulated by the installer by closing individual outlet openings, as a result of which the adhesive might be applied unevenly. Moreover, the outlet openings have a round cross section, which causes the bead to have a corresponding cross section.

An objective of the invention is to put forward an application nozzle that allows a uniform application of parallel beads of adhesive, especially with respect to the amount of adhesive that comes out of the application nozzle over the course of time.

SUMMARY OF THE INVENTION

An application nozzle for viscous adhesives has at least one flow element that has an inflow edge and an outflow edge and that is oriented in such a way that the flow element, while being completely surrounded by the volume flow of adhesive, uniformly distributes the volume flow of adhesive, taking into consideration the different flow paths leading from the feed opening to the individual nozzle openings.

When it comes to the above-mentioned viscous adhesive application cases, it has been found that shear rates within the range from 1 to 10 1/sec are attained when the adhesive is applied with a serrated spatula. Adhesives having a viscosity of 80 Pa·s at a shear rate of 5 1/sec can still just barely be applied manually using a serrated spatula. Therefore, the device and the nozzle are especially well-suited for applying high-viscosity adhesives that are particularly advantageous for the initial adhesion. Like in any other gluing procedure, a high initial adhesion is desirable.

The structure the nozzle according to one embodiment of the invention makes it possible to keep the applied amount of adhesive constant in the individual beads over the entire width of the nozzle.

The cavity inside the nozzle is interrupted by at least one flow element, but preferably by several flow elements of different sizes, so that the adhesive is uniformly distributed to the dispensing openings when it flows around such flow elements.

In one embodiment, the nozzle can have triangular or rectangular openings, so that individual adhesive beads having a triangular or rectangular cross section are formed when the adhesive is being applied.

The outlet openings selected preferably should be rectangular when it comes to gluing tiles.

The corners of the outlet openings can have a rounding radius.

The edges of the outlet openings do not have to be straight, but rather, they can also be curved. Since the adhesive compound can partially expand or contract after coming out of the nozzle, straight edges of the outlet openings cause the edges of the adhesive beads to be convex, which can be compensated for if the outlet openings have concave edges.

The application nozzle can be part of a device comprising at least one adhesive container onto which this application nozzle is mounted.

The application nozzle is also suitable for devices that apply a two-component adhesive that is mixed in the nozzle or upstream from the nozzle.

Such an application nozzle can be arranged with respect to a container in such a manner that the container and the application nozzle can be rotated with respect to each other, thus allowing an individual working position to be selected.

The application nozzle as described here is particularly well-suited for adhesive viscosities greater than 80 Pa·s at a shear rate of 5 1/sec.

Preferably, the flow elements should divide the volume flow of the adhesive in such a way that identical amounts of adhesive come out of the individual nozzle openings per unit of time. At the same time, certain flow elements can also serve to thoroughly mix the adhesive, especially when a two-component adhesive is being used of the type that finds widespread use nowadays.

It has been found that a preferred cross section for the flow elements is an oval or elliptical cross section, as seen in the direction of flow of the adhesive. These flow elements should be oriented in the nozzle housing in such a way that the adhesive flows against the narrow side of these elements. Such a cross section ensures that the adhesive stream will be conveyed optimally without creating any significant dead zones, especially on the outflow side of the flow elements.

In some cases, a drop-shaped cross section of the flow elements, as seen in the flow direction of the adhesive, can be advantageous, whereby the flow elements should be oriented in such a way that the adhesive flows against the rounded-off side of these elements.

In the nozzle housing, there should be at least two flow elements distributed over the interior of the housing.

Even more preferred is an arrangement consisting of flow elements having differently sized cross-sectional surface areas. Flow elements with a larger cross-sectional surface area are then arranged in the center of the interior of the nozzle housing relative to the application edge.

In order to optimally convey the adhesive from the feed opening to the row of nozzle openings, a plurality of flow elements may be provided that are staggered in several rows as seen in the direction of flow of the adhesive.

Here, the flow elements may be staggered in rows with a smaller number of flow elements having a large cross section to a larger number of flow elements having a small cross section, whereby the flow elements with the large cross sections are arranged closer to the feed opening, while the flow elements with the small cross section are arranged closer to the nozzle openings.

Moreover, the flow elements of the individual rows are arranged offset with respect to each other as seen in the direction of flow of the adhesive, so that the adhesive stream, once it has flowed through the space between two flow elements, reaches at least one additional flow element which, in turn, divides the flow into at least two partial flows.

The triangular cross section makes it easier to insert and press the hardwood planks in place, especially if they have a tongue-and-groove connection.

As described above, such application nozzles are supposed to apply a uniform layer of adhesive consisting of parallel adhesive strips onto a surface that is to be glued. These adhesive beads can then be compressed in the area of the surface that is to be glued when a component is glued in place. It can be advantageous for a thin adhesive film to be present between the adhesive beads, so that the entire surface area is coated, and this coating functions as a water vapor barrier, so that the wood is protected against swelling excessively when water evaporates from a floor screed that is still too wet. In order to achieve this, adjacent nozzle openings are connected by a narrow nozzle gap that has a certain gap height. Through this gap, a small amount of adhesive in the form of an adhesive film is then applied between the adhesive beads. This thin adhesive film formed between the adhesive beads also functions as a water vapor barrier after the hardening has taken place. Experiments have shown that this effect can also be achieved without a defined gap if the two halves are not screwed all that tightly to each other.

When the nozzle openings have a triangular outlet cross section, the individual nozzle openings are joined to each other at their wider lower edge by such a nozzle gap.

Regarding the housing of the application nozzle, an application edge with which the application nozzle is moved along an application surface should be configured on the side that forms the bottom. The nozzle gap described above is then arranged on this side, which forms the application edge.

In order to achieve an easy-to-handle structure, the nozzle housing should consist of at least an upper part and a lower part.

With such a structure, the upper part and the lower part rest on each other along the nozzle openings. This also makes it possible for the nozzle openings to be configured in the form of slits, either in the upper part or in the lower part, and for the other part to cover the slits, thus creating the nozzle openings.

The flow elements having an oval or elliptical cross section are optimally dimensioned when the ratio of the small axis to the large axis of the cross sections of the flow elements is between 1:1 and 1:20, preferably between 1:2 and 1:15, especially preferably between 1:3 and 1:5.

It has been found that the effect of the elliptical or oval flow elements is optimized by the difference between the two half-axes of the cross section.

The ideal configuration of the shape of the flow elements, preferably of the elliptical cross sections of the flow elements, as well as their staggering as seen in the direction of flow of the adhesive, depends on the geometry of the interior of the nozzle housing, especially on how markedly the nozzle housing widens from the feed opening towards the nozzle openings.

In addition to the flow elements, at least a part of the interior surface of the nozzle housing can be provided with a ridged structure. These additional ridges can influence the flow of the adhesive in the nozzle; among other things, the through mixing of the adhesive can be enhanced in this manner.

At the same time, the flow elements can assume the function of spacers between the upper part and the lower part of the nozzle housing. The upper part and the lower part of the nozzle housing can be screwed together or joined in some other manner in the area of such flow elements that serve as spacers.

In another embodiment, a sieve is installed in the interior of the application nozzle upstream from the nozzle openings. This sieve serves to convey and separate granules that are present in the adhesive so that these granules only come out in an area located towards the application edge. Such a sieve is preferably employed in an application nozzle that has a nozzle gap between the individual nozzle openings, as has been described above. In conjunction with such a nozzle gap, the granules are conveyed in such a way that these granules can only pass through the nozzle gap. The adhesive beads thus formed are then free of this fraction of granules in the upper area. However, in conjunction with a sieve, the gap is set to match at least the diameter of the granules.

DESCRIPTION OF THE DRAWINGS

Additional objectives, advantages, features and application possibilities of the present invention will be explained on the basis of the description below of embodiments, making reference to the drawings. In this context, all of the features described in words and/or depicted in figures, either on their own or in any meaningful combination, constitute the subject matter of the present invention, also irrespective of their compilation in the claims to which they refer back.

The drawings show the following.

DETAILED DESCRIPTION OF EMBODIMENTS

Figure 1:
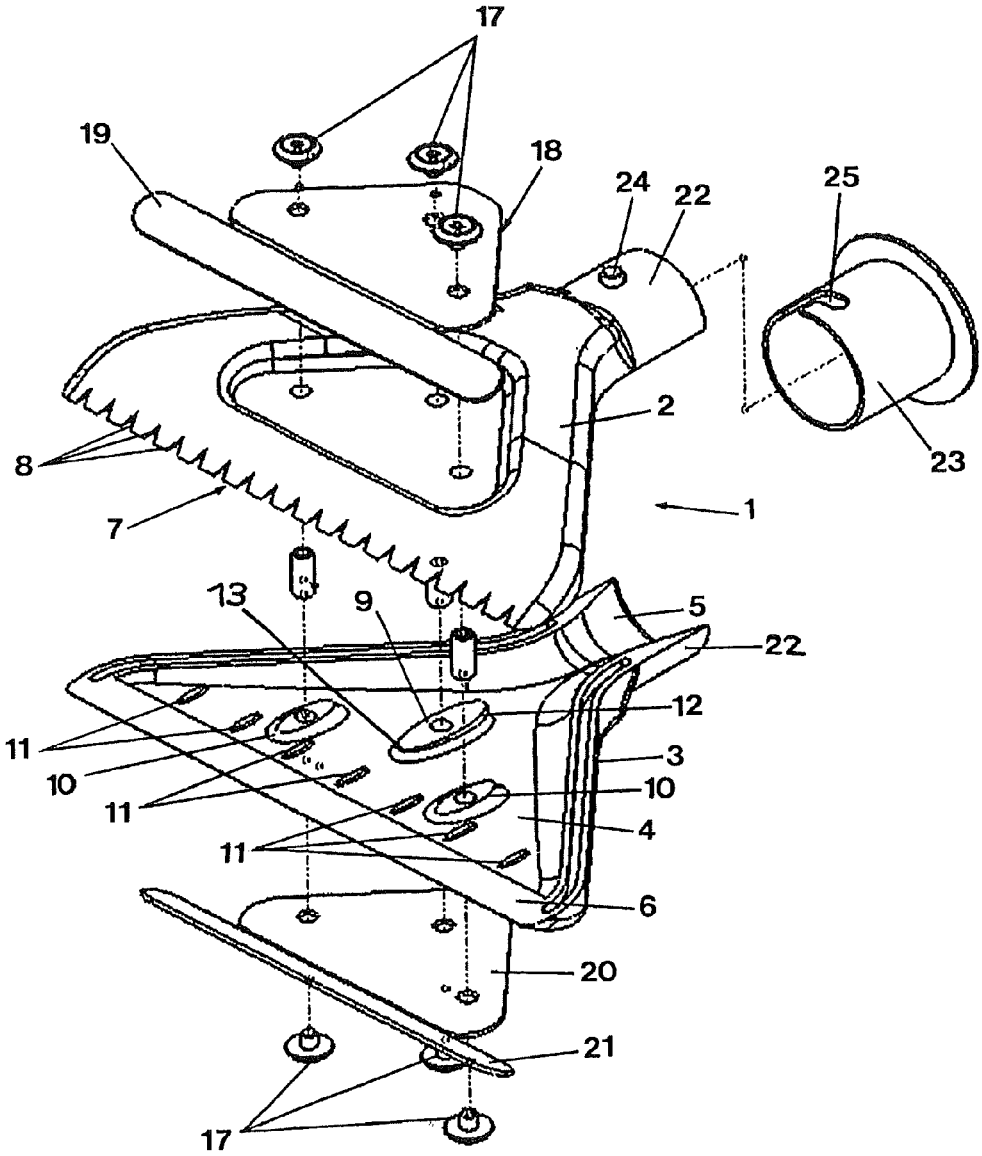
FIG. 1 a perspective, exploded view of an application nozzle for viscous adhesives according to one embodiment of the invention.

The application nozzle, which is shown in FIG. 1, is suitable for applying viscous adhesives in the form of adhesive beads over a relatively wide surface area.

The application nozzle comprises a nozzle housing 1 having an upper part 2 and a lower part 3. The upper part 2 and the lower part 3 are depicted FIGS. 2 and 3 in an enlarged view, each showing the interior.

The upper part 2 and lower part 3 enclose an interior 4. In a top view, the entire application nozzle has a triangular or trapezoidal shape with a feed opening 5 on the narrow side.

On the wide side of the lower part 3, there is an application edge 6 that has a smooth shape that tapers to a tip, as seen in the cross-sectional direction. The corresponding edge 7 of the upper part 2 is provided with V-shaped cutouts 8 that form triangular nozzle openings when the upper part 2 and the lower part 3 are joined together.

Figure 2:
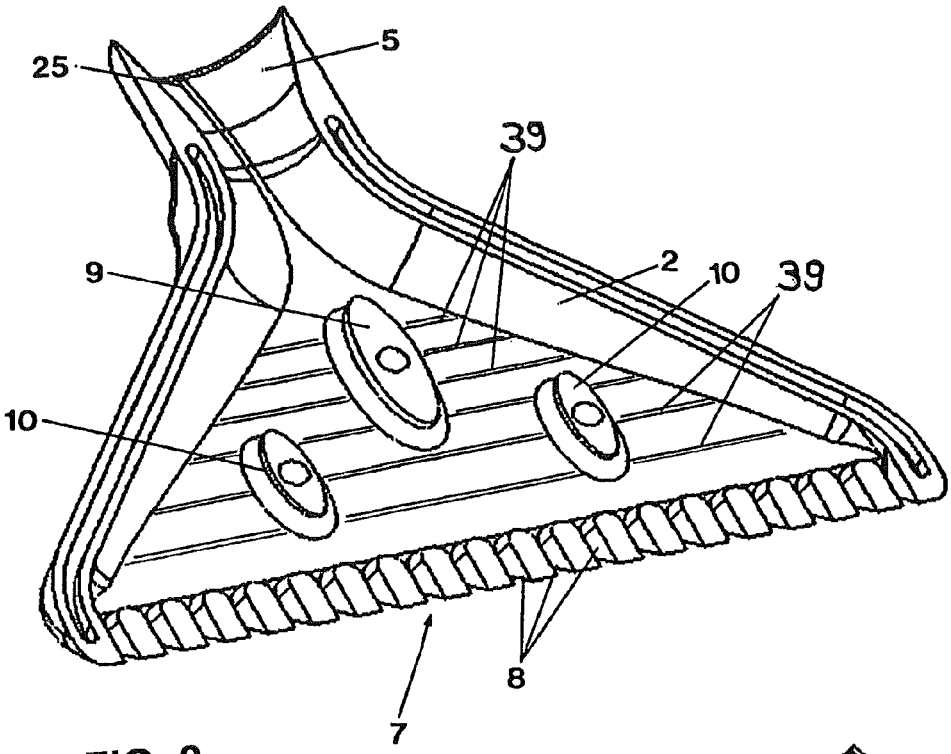
FIG. 2 the upper part of the application nozzle of FIG. 1 with a view of the interior.

As shown in FIGS. 1 and 2, a plurality of these V-shaped cutouts 8 is uniformly distributed along the edge 7.

It can also be seen in FIG. 1 that, due to the shape of the nozzle housing 1, the interior 4 widens from the feed opening 5 towards the edges 6 and 7.

Figure 3:
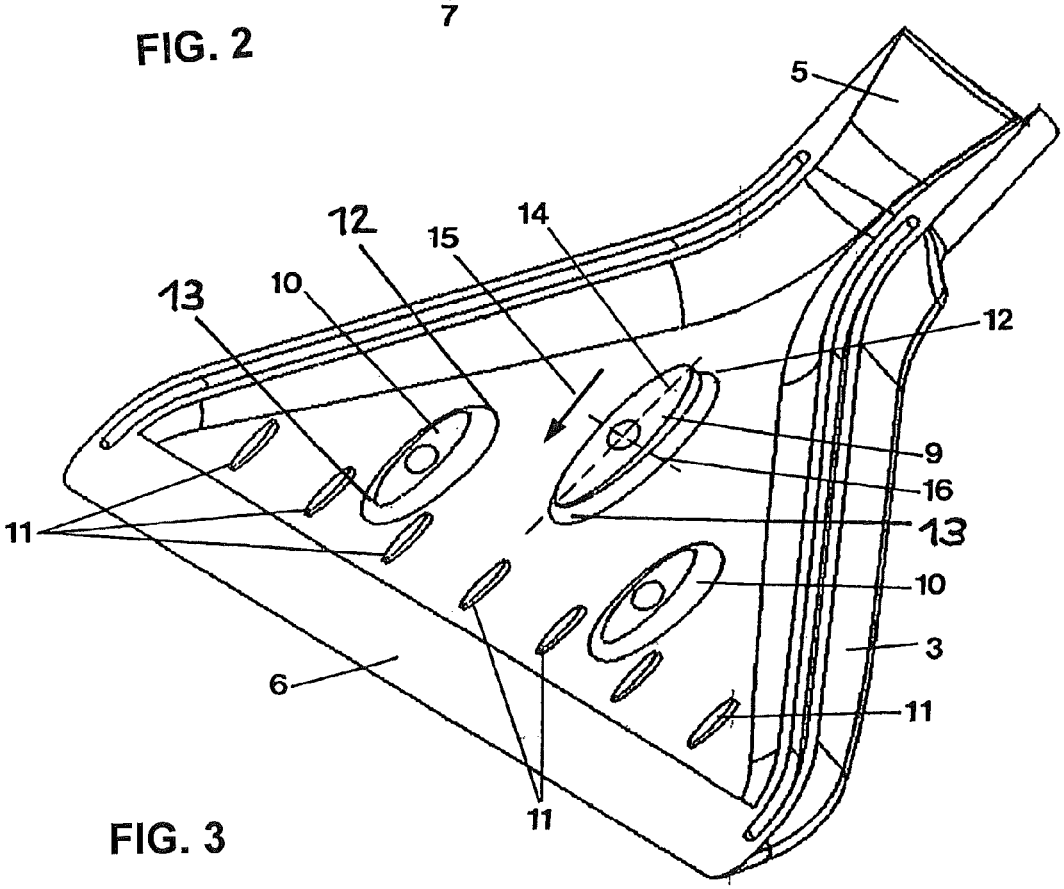
FIG. 3 the lower part of the application nozzle of FIG. 1 with a view of the interior.

Several flow elements 9, 10 and 11 having an oval or elliptical cross section are present in the interior 4 of the nozzle housing 1. These flow elements each have an inflow edge 12 and an outflow edge 13 on the narrow ends. They are oriented in the interior 4 in such a manner that the large axis 14 of the elliptical cross section of the flow elements 9, 10 and 11—which for illustration purposes is shown in FIG. 3 with reference to the middle flow element 9—is oriented in the direction of the volume flow of adhesive entering the interior 4 via the feed opening 5.

The elliptical or oval cross section of the flow elements 9, 10 and 11 ensures that the adhesive flows uniformly around the flow elements.

The flow elements 9, 10 and 11, which have different cross sections, are arranged in rows perpendicular to the direction of flow of the adhesive, which is indicated by an arrow 15, whereby the first row encompasses the flow element(s) 9 having the largest cross section, followed by a row of flow element(s) 10 having a medium-sized cross section, and a row of flow element(s) 11 having the smallest cross section. Moreover, in this example, only one flow element 9 is present in the first row, while the second row has two flow elements 10 and the third row has seven flow elements 11. Furthermore, the flow elements 9, 10 and 11 of the subsequent rows are staggered in such a way that they are offset with respect to each other perpendicular to the flow direction (arrow 15).

The flow elements 9, 10 and 11 ensure that the volume flow of the adhesive entering the interior 4 via the feed opening 5 is uniformly distributed over the widening cross section towards the nozzle openings 8. This means that the adhesive is divided at the flow element 9, it then flows to the two flow elements 10 of the next row where, in turn, it is divided into four adhesive streams running towards the flow elements 11 of the last row.

The number of individual flow elements 9, 10 and 11 indicated here in the various rows is only given by way of an example and has to be adapted as a function of the actual circumstances. By means of a suitable selection of the number of flow elements as well as of the dimensions of the cross sections, it can be achieved that the same volumes of adhesive flow through the nozzle openings 8 over the course of time.

The width-to-length ratio of the ellipsis of the cross section of the flow element 9 is greater at the inlet opening since that is where the incoming adhesive stream is first distributed to the sides, where it can built up a higher pressure. The flow elements 10 in the next row are arranged offset to each other, so that the incoming stream of adhesive is once again divided there. For the same reason, the flow elements 11 in the third row are arranged in the spaces between the elements of the preceding row. The outlet openings 8 are located between the flow elements 11, that is to say, the flow elements 11 are not situated directly in front of an outlet opening 8, but rather between them.

As already mentioned above, the dimensions of the cross sections of the flow elements 9, 10 and 11 should be selected in such a way that the ratio of the small half-axis—designated in FIG. 3 with the reference numeral 16—to the large half-axis 14 is about 1:3 on the inlet side of the adhesive for the flow element 9 to about 1:5 for the flow elements 11 on the side of the nozzle openings 8. The ratio could also vary up to 1:20 for the flow elements 11 on the side of the nozzle openings 8.

As shown in FIG. 1, at least the flow elements 9 and 10 with the large cross-sectional diameters could serve as spacers for the upper part 2, which is placed onto the lower part 3. At the same time, the upper part 2 can be screwed onto the lower part 3 in the area of these flow elements 9 and 10 by means of screws that are generally designated by the reference numeral 17. The parts of the nozzle can also be held together by clamps.

As the views of the upper part 2 in FIG. 2 and of the lower part 3 in FIG. 1 show, the flow elements 9 and 10 having the large cross section are divided approximately in the middle so that, when the upper part 2 and the lower part 3 have been screwed together, these halves combine to form the appertaining flow elements 9 and 10. These flow elements could also be shaped on only at the top or at the bottom. The smaller flow elements 11, in contrast, are only shaped onto the lower part 3. As an alternative, they can also only be present on the upper part 2 or, if the dimensions permit, likewise be divided in the middle.

A cover 18 that has a cover strip 19 on its front end is placed on the top of the upper part 2. This cover 18 is held on the upper part 2 by means of the screws 17. The cover strip 19 is dimensioned and oriented in such a way that it covers the top of the edge 7 with the V-shaped cutouts 8. A corresponding cover 20 with a cover strip 21 can be placed onto the outside of the lower part 3 in such a way the cover strip 21 is associated with the application edge 6. At least the cover strip 21 can be made of a flexible material so that it can adapt to the shape of the application surface when the adhesive is applied.

As an additional safety measure for holding the upper part 2 and the lower part 3 together, a connecting piece 23 that latches like a bayonet connector with a pin 24 and a groove guide 25 can be clicked onto the rear tubular end 22 of the upper part 2 and lower part 3. The pin 24 and the groove guide 25 can also conversely be associated with the connecting piece 23 or the tubular end 22.

The inner surfaces of the nozzle housing 1 can be provided with a ridged structure. Such ridges 39 are located, for example, on the inner surface of the upper part 2 of FIG. 2. These ridges 39 are depressions that are created into the inner surface of the upper part 2. As an alternative, it is also possible to configure the ridged structure in the form of elevations or webs. This ridged structure, which can be formed not only on the upper part 2 but also on the lower part 3, enhances the thorough mixing of the adhesive, especially when the adhesive is a two-component adhesive. Moreover, the ridged structure could have a V-shaped arrangement, that is to say, the ridges run in a V-shaped pattern starting at the feed opening 5 towards the outside, so that they also help to convey the adhesive to the external nozzle openings 8.

Figure 4:
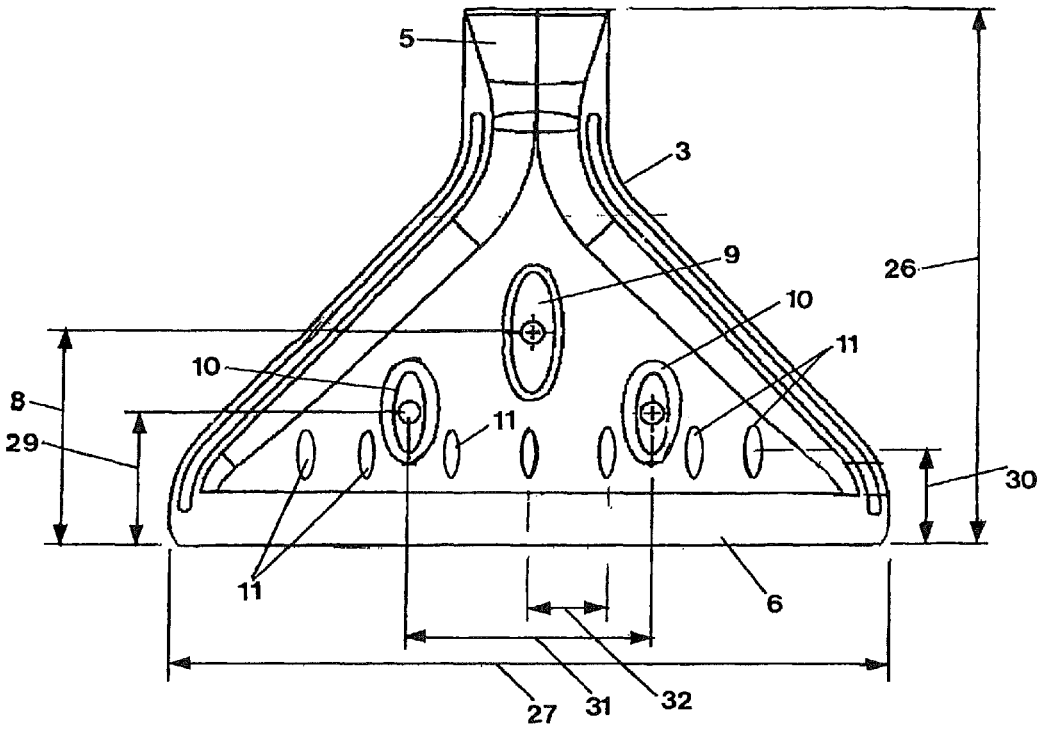
FIG. 4 a top view of the lower part depicted in FIGS. 1 and 3.

The dimensioning of the application nozzle is shown by way of an example in FIG. 1, as seen from a top view of the lower part 3 that is depicted in FIG. 4.

As is shown in FIG. 4, in this embodiment the nozzle housing 1 or the lower part 3 has a length 26 of 200 mm. The width 27 along the application edge 6 amounts to 250 mm.

The distance 28 from the center of the flow element 9 having an elliptical cross section to the application edge 6 is 80 mm, the distance 29 from the center of the flow element 10 to the application edge 6 is 50 mm, and the distance 30 from the center of the flow element 11 to the application edge 6 is 30 mm.

The axis ratios of the elliptical cross section of the flow elements 9, 10 and 11 of the large half-axis 14 with respect to the small half-axis 16, as they are shown in FIG. 3 for the large flow element 9, are 45 mm to 15 mm in the case of the flow elements 9, 30 mm to 11 mm in the case of the flow elements 10, and 15 mm to 3 mm in the case of the smallest flow element 11.

The distance 31 between the centers of the two middle flow elements 10 is about 85 mm, whereas the distance 32 between adjacent flow elements 11 is about 28 mm.

The dimensions indicated above are reference values than can be increased or decreased at corresponding ratios for application nozzles having other dimensions.

Figure 5:
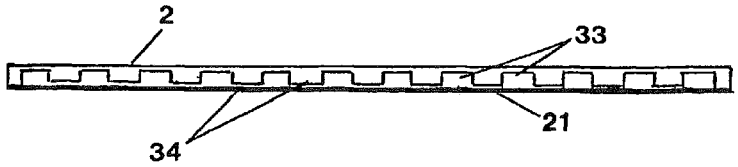
FIG. 5 a top view of only the nozzle openings of an assembled application nozzle.

FIG. 5 shows merely schematically the view of the nozzle openings which, in the embodiment shown, in contrast to the previously described embodiment, are formed by rectangular cutouts 33 in the upper part 2. Moreover, it can be seen in FIG. 5 that adjacent nozzle openings 33 are connected to each other by means of a narrow nozzle gap 34. Small amounts of adhesive can pass through this gap 34, so that also in the area between two nozzle openings 33, the application surface is coated with a thin adhesive film. The rectangular cross section of the cutouts 33 forms adhesive beads having a rectangular cross section on the application surface. The gaps 34 can also be provided when the nozzle openings have a V-shaped cross section.

Figure 6:
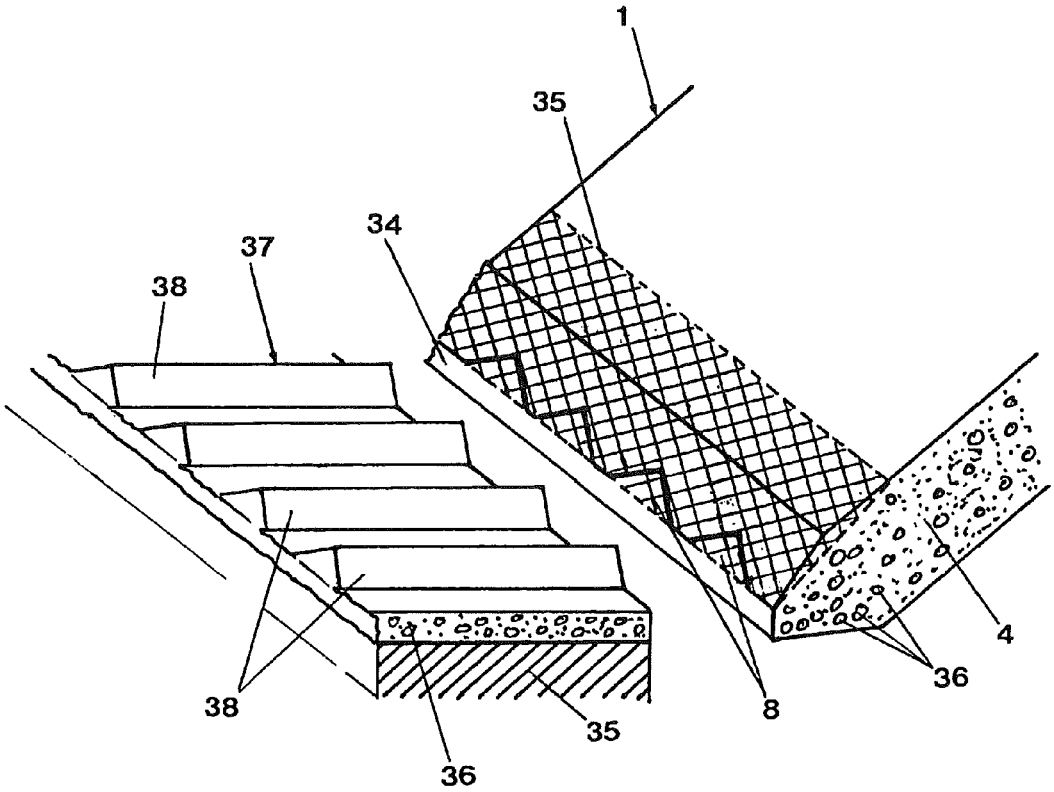
FIG. 6 a schematic depiction of an application nozzle into which an additional sieve have been installed.

FIG. 6 merely schematically shows an application nozzle having a nozzle housing 1 as well as triangular nozzle openings 8, as is the case for the application nozzle shown in FIG. 1, as well as a nozzle gap 34 that was previously described, for instance, on the basis of FIG. 5. A sieve 35 is present in the interior 4 of the nozzle housing 1. This sieve 35 is installed in the interior in such a way that it covers only the area of the nozzle openings 8 but not the area of the nozzle gap 34. Such an arrangement is employed whenever an adhesive is to be applied that contains a granular fraction 36. Due to the mesh size of the sieve 35, the granular fraction 36 cannot pass through the sieve and is conveyed downwards to the nozzle gap 34. As a result, it can be achieved that the adhesive compound applied onto a substrate—designated in FIG. 6 with the reference numeral 37—contains the granular fraction 36 only in the bottom area, while the top areas of the adhesive beads 38 are free of these granules.

While preferred embodiments of the invention have been described and illustrated here, various changes, substitutions and modifications to the described embodiments will become apparent to those of ordinary skill in the art without thereby departing from the scope and spirit of the invention.

LIST OF REFERENCE NUMERALS

1 nozzle housing
2 upper part
3 lower part
4 interior
5 feed opening
6 application edge
7 edge

8 V-shaped cutout
9 flow element
10 flow element
11 flow element
12 inflow edge
13 outflow edge
14 large axis
15 arrow indicating the direction of flow
16 small half-axis
17 screw
18 cover
19 cover strip
20 cover
21 cover strip
22 tubular end
23 connecting piece
24 pin
25 groove guide
length of 3
width of 3
28 distance between 9 and 6
29 distance between 10 and 6
30 distance between 11 and 6
31 distance between two 10s
32 distance between two 11s
33 rectangular cross section
34 gap
35 sieve
36 granular fraction
37 adhesive compound
38 adhesive beads
39 ridges

The invention claimed is:

1. An application nozzle for viscous adhesives, comprising:

a nozzle housing (1) encompassing an interior (4), having an application edge (6) along which a plurality of nozzle openings (8, 33) are arranged, and having at least one feed opening (5) located opposite from the application edge (6), wherein the interior (4) of the nozzle housing (1) widens from the feed opening (5) towards the nozzle openings (8, 33), as seen in the direction of the application edge (6);

at least one flow element (9, 10, 11) that has an inflow edge (12) and an outflow edge (13) and that is oriented in such a way that the flow element, while being completely surrounded by the volume flow of adhesive, uniformly distributes the volume flow of adhesive, taking into consideration the different flow paths leading from the feed opening (5) to the individual nozzle openings (8, 33); and a sieve (35) installed in the interior (4) upstream from the nozzle openings (8, 33) that separates granules that are present in an adhesive so that such granules only come out of the nozzle openings in an area located towards the application edge (6).

2. The application nozzle according to claim 1, characterized in that at least two flow elements (9, 10, 11) divide the volume flow of adhesive in such a way that identical amounts of adhesive come out of the individual nozzle openings (8, 33) per unit of time.

3. The application nozzle according to claim 1, characterized in that the flow elements (9, 10, 11) have an oval or elliptical cross section, as seen in the direction of flow of the adhesive.

4. The application nozzle according to claim 3, characterized in that the flow elements (9, 10, 11) are oriented in such a way that the adhesive flows against the narrow side (12) of these elements.

5. The application nozzle according to claim 1, characterized in that the flow elements (9, 10, 11) have a drop-shaped cross section, as seen in the flow direction (15) of the adhesive.

6. The application nozzle according to claim 5, characterized in that the flow elements (9, 10, 11) are oriented in such a way that the adhesive flows against the rounded-off side (12) of these elements.

7. The application nozzle according to claim 1, characterized in that at least three flow elements (9, 10, 11) are arranged in the nozzle housing (1).

8. The application nozzle according to claim 1, characterized in that the flow elements (9, 10, 11) have differently sized cross-sectional surface areas, whereby flow element(s) (9) with a larger cross-sectional surface area are arranged in the center of the interior (4) of the nozzle housing (1) relative to the length of the application edge (6).

9. The application nozzle according to claim 1, characterized in that the flow elements (9, 10, 11) are staggered in several rows, as seen in the flow direction (15) of the adhesive.

10. The application nozzle according to claim 9, characterized in that, as seen in the flow direction (15) of the adhesive, the flow elements (9, 10, 11) are staggered in rows with a smaller number of flow element(s) (9) having a large cross section to a larger number of flow element(s) (10, 11) having a small cross section.

11. The application nozzle according to claim 10, characterized in that the flow elements (9, 10, 11) of the individual rows are arranged offset with respect to each other as seen in the direction of flow (15) of the adhesive.

12. The application nozzle according to claim 1, characterized in that the nozzle openings (8) have an outlet cross section shape selected from the group consisting of: triangular and rectangular.

13. The application nozzle according to claim 1, characterized in that adjacent nozzle openings (8, 33) are connected by a narrow nozzle gap (34).

14. The application nozzle according to claim 13, characterized in that the side of the nozzle housing (1; 3) that forms the bottom has the application edge (6), and the nozzle gap is arranged on this side of the nozzle openings (8, 33).

15. The application nozzle according to claim 1, characterized in that the nozzle housing (1) consists of at least an upper part (2) and a lower part (3).

16. The application nozzle according to claim 15, characterized in that the upper part (2) and the lower part (3) rest on each other along the nozzle openings (8, 33).

17. The application nozzle according to claim 16, characterized in that the nozzle openings (8, 33) are configured in the form of slits either in the upper part (2) or in the lower part (3), and the other part covers the slits, thus forming the nozzle openings (8, 33).

18. The application nozzle according to claim 3, characterized in that the ratio of the small axis (16) to the large axis (14) of the cross sections of the flow elements (9, 10, 11) having an oval or elliptical cross section is between 1:1 and 1:20.

19. The application nozzle according to claim 1, characterized in that at least a part of the interior surface of the nozzle housing (1) has a ridged structure (39).

20. The application nozzle according to claim 15, characterized in that the flow elements (9, 10, 11) constitute spacers between the upper part (2) and the lower part (3).

21. The application nozzle according to claim 13, characterized in that the sieve (35) is arranged in such a way that the granules are conveyed along the sieve (35) towards the nozzle gap (34).

* * * * *